US008746476B1

(12) United States Patent
Clause et al.

(10) Patent No.: US 8,746,476 B1
(45) Date of Patent: Jun. 10, 2014

(54) CLOSURE HAVING A SEAL PIERCING UNIT

(75) Inventors: Mark Clause, New Castle, PA (US); Brett Niggel, Corry, PA (US)

(73) Assignee: Berlin Packaging, LLC, Chicago, IL (US)

( * ) Notice: Subject to any disclaimer, the term of this patent is extended or adjusted under 35 U.S.C. 154(b) by 695 days.

(21) Appl. No.: 12/658,756

(22) Filed: Feb. 11, 2010

Related U.S. Application Data

(60) Provisional application No. 61/207,678, filed on Feb. 13, 2009.

(51) Int. Cl.
*B65D 47/00* (2006.01)
*B65D 39/00* (2006.01)
*B65D 47/36* (2006.01)

(52) U.S. Cl.
CPC ..... *B65D 47/36* (2013.01)
USPC ..... 215/277; 215/297; 215/301; 206/222

(58) Field of Classification Search
CPC ..... B65D 39/00; B65D 83/00; B65D 17/42; B65D 47/08; B65D 51/18; B65D 51/22
USPC ..... 220/277, 281, 276, 359.1, 259.1, 254.2, 220/254.3, 255.1, 255, 258.1–258.3, 258.5; 206/222, 219; 222/81, 541.6, 541.5, 222/541.9, 562, 563, 556, 153.02, 153.06, 222/153.07; 215/301, 298, 305, 297, 254, 215/232, DIG. 8, 235, 227
See application file for complete search history.

(56) References Cited

U.S. PATENT DOCUMENTS

| | | | | |
|---|---|---|---|---|
| 3,187,918 | A * | 6/1965 | Moore | 215/11.6 |
| 3,406,872 | A | 10/1968 | Fiquet et al. | |
| 4,634,013 | A | 1/1987 | Bar-Kokhba | |
| 4,709,830 | A | 12/1987 | Kreiseder | |
| 4,722,449 | A | 2/1988 | Dubach | |
| 4,727,999 | A * | 3/1988 | Gach | 215/232 |
| 4,754,889 | A * | 7/1988 | Debetencourt | 215/232 |
| 4,770,305 | A | 9/1988 | Su | |
| 4,795,043 | A | 1/1989 | Odet et al. | |
| 4,993,569 | A | 2/1991 | Osip et al. | |
| 5,090,582 | A | 2/1992 | Art et al. | |
| 5,297,696 | A | 3/1994 | Bernstein et al. | |
| 5,366,114 | A | 11/1994 | Bernstein et al. | |
| 5,758,788 | A | 6/1998 | Lifshey | |
| 5,850,930 | A | 12/1998 | Jonsson et al. | |
| 5,853,109 | A | 12/1998 | Elliott | |
| 5,947,318 | A | 9/1999 | Palm | |
| 6,045,004 | A | 4/2000 | Elliott | |

(Continued)

*Primary Examiner* — Anthony Stashick
*Assistant Examiner* — Ernesto Grano
(74) *Attorney, Agent, or Firm* — Adam K. Sacharoff; Much Shelist

(57) ABSTRACT

A seal covering a discharge port of a container is opened without leaving superfluous elements on the container by a container closure unit which has seal-piercing knife-like elements mounted on a flexible dome-shaped base which is located to place the knife-like elements adjacent to the seal. The dome-shaped base is flexed to move the knife-like elements through the seal and then to move them outwardly toward the periphery of the seal to cut slits in the seal. The slits act as fluid passages to permit decanting of the fluid from the container. Once the seal has been opened, the dome-shaped base is removed using a pull ring and discarded. The container closure unit has a cap which is used to close the container discharge port between uses.

12 Claims, 16 Drawing Sheets

(56) References Cited

U.S. PATENT DOCUMENTS

| | | | | |
|---|---|---|---|---|
| 6,076,704 | A | 6/2000 | Weiler et al. | |
| 6,161,728 | A | 12/2000 | Dark | |
| 6,185,906 | B1 | 2/2001 | Mogard et al. | |
| 6,536,627 | B1 | 3/2003 | Benoit-Gonin et al. | |
| 7,163,127 | B2 | 1/2007 | Seelhofer | |
| 7,410,071 | B1 | 8/2008 | Seib et al. | |
| 7,427,005 | B1 | 9/2008 | Lohrman | |
| 7,458,486 | B2 | 12/2008 | Weist et al. | |
| 2004/0007587 | A1 | 1/2004 | Westphal | |
| 2004/0026422 | A1 | 2/2004 | Westphal | |
| 2006/0151421 | A1* | 7/2006 | Rho | 215/297 |
| 2006/0289376 | A1 | 12/2006 | Von Spreckelsen | |
| 2007/0181522 | A1 | 8/2007 | Davidson | |

* cited by examiner

CLOSURE HAVING A SEAL PIERCING UNIT

TECHNICAL FIELD OF THE INVENTION

The present invention relates to the general art of containers, and to the particular field of container closures.

CROSS REFERENCE TO RELATED APPLICATION

This application claims the benefit of the filing date of Provisional Patent Application Ser. No. 61/207,678, filed on Feb. 13, 2009 filed by the same inventor.

BACKGROUND OF THE INVENTION

Often, containers are encountered which have, in addition to a screw cap, a seal or film over the opening which is designed to provide security from and/or evidence of tampering, reduce bacterial infection, prevent volatile liquid from evaporating, prevent fluid from leaking out of the container, prevent oxygen or other contaminants from entering the container, or otherwise protect the product. Commonly these include sealed containers for medicine, glue and the like where a plastic container top is actually sealed closed during the molding process. Other examples include containers which contain tablets, dry ingredients, oil, or the like, where a foil or plastic film is sealed across the top of the container after the contents have been placed inside. The seals are often welded to the container to cover the opening of the container. The seal can also be film-reinforced paper. In a pour spout type container it is sometimes desirable to place a seal somewhere axially along the pour spout lumen or passageway, such as across a dispensing opening in the paperboard which forms the carton, with the opening being aligned with the pour spout lumen. These seals must be punctured or ruptured to gain access to the contents of the container.

The film-reinforced paper passing through and below the welded-on spout, or the film membrane running within the spout must be cut open or torn open towards the opening or pressed away from the opening so a fluid passage is defined whereby the fluid or the pourable material may be poured or shaken out of the container through the spout. Manual removal of the seal can be cumbersome, annoying and, in some cases, not possible. If a user has impaired finger dexterity or large fingers, such seal removal can be difficult if not impossible.

Accordingly, the art contains several designs which are intended to open these seals by puncturing or tearing the seal.

One form of such designs includes a sleeve arranged within the spout which on rotating a screw-on cap causes a lower edge of the device to move toward the seal. The lower edge of the sleeve is equipped with cutting or tearing teeth which will cut or tear the seal. These allow for forced screwing of the cap onto the container to allow the saw edge to break the seal. Such seal openers however do not function satisfactorily. The openings through the seal are often are not cut cleanly from the film or the film membrane, but rather the sleeve simply presses a piece of film out of the seal The remaining edge is frayed and thus may have shreds of paper or film projecting into the passage. These shreds often project downwards into the container. On dispensing of the product, the shreds may block or impede the path of the outflowing product. This problem is exacerbated in large packages which may have large and strong seals. In some seals, particularly large seals, the seal may flex under the influence of the cutter and impede the cutting action of the remainder of the seal. While the art has suggested pre-weakening such seals at selected locations in order to expedite the seal cutting or tearing process, such suggestions are expensive and may require expensive installations and handling during the production process. Even then, the devices which are intended to open a seal by cutting with teeth can remain inefficient and ineffective. Still further, if a consumer is required to remove a cap from a container and then manipulate that cap in order to break a seal, the design will be disadvantaged. The consumer may drop the cap, or become annoyed by the extra steps associated with opening a container or the like. The product can be spilled after the seal is broken and before the main cap is returned to its proper position. This will present further drawbacks to such a seal-breaker design. Still further, during this seal-breaking operation, the user may come into contact with the product, which may be undesirable either from the user's standpoint, or from a potential of contaminating the product.

Other designs rely on a piercing member which is located on the top of the cap. In such designs, the cap is removed from the container, inverted 180 degrees and then a piercing member is pressed onto the seal to effect rupture. Still other devices such as a "can opener" or "spike" are available which are separate from the cap and which can be used to open these sealed containers. Even if the piercing element is attached to the cap in a manner which does not required inversion of the cap, the designs presently known to the inventor have many drawbacks These devices are often cumbersome and require a great degree of manual dexterity. Many are not operable by those who cannot provide enough pressure to cause the rupture of the seal or film. Still further, if the puncturing device is small, it may be difficult to dispense the contents from the container. If the puncturing device is large, the act of puncturing the seal may cause pieces of the seal to break off and drop into the container or drop into the liquid as it is being dispensed from the container.

Still further, with all the above-discussed designs, there are elements that once used to open the seal are superfluous to the continued operation and functioning of the closure member. As such, these elements are, in essence, in the way and can become a source of problems.

Therefore, there is a need for a seal opening device that is easy to use and is effective and which can be removed and discarded after use.

SUMMARY OF THE INVENTION

These, and other, objects are achieved by a container closure unit which opens a seal covering an discharge port of a container and which is removed after the seal has been opened. The closure unit has a seal piercing unit releasably mounted on a base element by a tearable connection and which includes knife-like elements mounted on a flexible dome-shaped base to be positioned adjacent to the seal when the base element is secured to the container. The flexible dome-shaped base is initially convex with respect to the seal, but is flexed into a concave orientation when a user pushes the dome-shaped base toward the seal. This pushing forces the knife-like elements into contact with the seal, and then the curvature change of the dome-shaped base causes those knife-like elements to pierce the seal and tear slits in the seal. The slits will act as fluid passages during decanting of the fluid from the container. Once the seal has been punctured, the seal piercing unit is removed from the base using a pull ring mounted on the dome-shaped base. The pull ring is grasped and pulled away from the container and the dome-shaped base is torn out of the base element along the tearable connection. The dome-shaped base and the knife-like elements mounted thereon is then discarded. The closure unit has a cap hingeably mounted on the base element to move between a base element covering condition in which the container discharge port is covered and closed and a base element opening position in which the container discharge port is open whereby fluid can be discharged or decanted from the container. In one form of the closure unit, a second seal is mounted on the seal piercing unit to cover the seal on the container and which is also pierced by the knife-like elements during operation thereof to open the container seal. The second seal further ensures against leakage of fluid from the container. One form of the closure unit has a tubular element mounted in the base element to surround the container pouring spout and which has an internal thread that threadably mates with an external thread on the container pouring spout to securely mount the closure unit on the container adjacent to the container pouring spout. A further tubular element can be mounted on the cap to snugly surround the tubular element on the base element when the cap is in the covering condition to further ensure a secure closure of the container by the container closure unit.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

Figure 13:
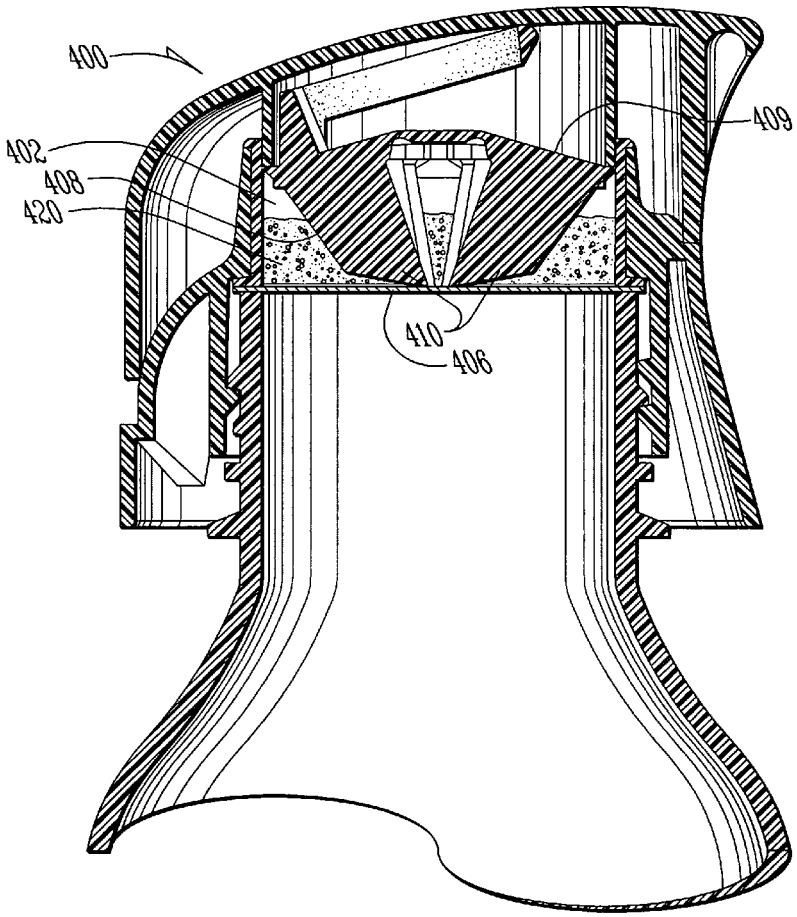
FIG. 13 is a side elevational view of a fourth form of a closure cap embodying the principles of the present invention in place on a container.
Figure 13A:
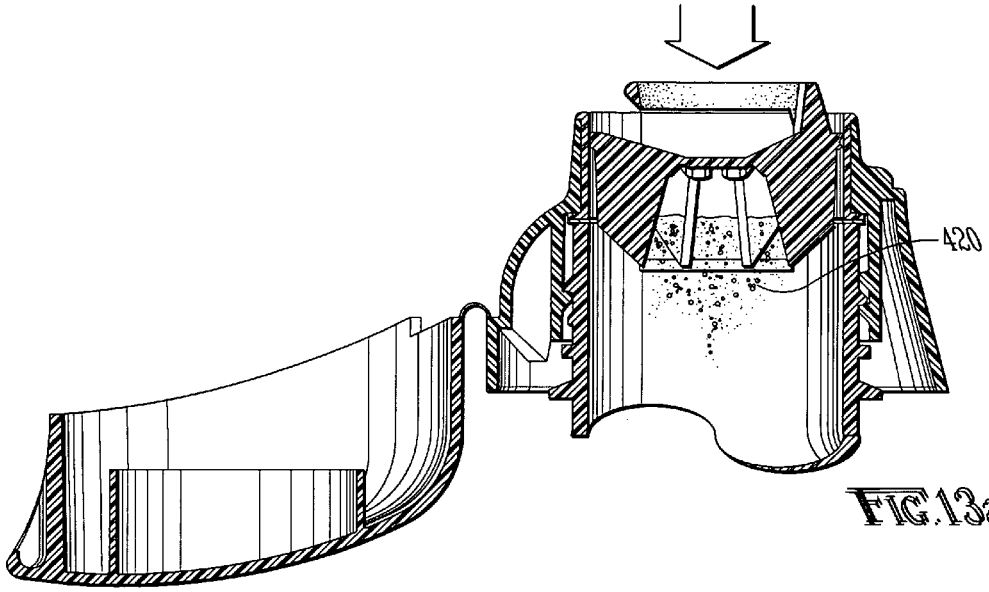

FIG. 13*a* is a side elevational view of the fourth form of the cap in a seal-piercing condition.

Figure 13B:
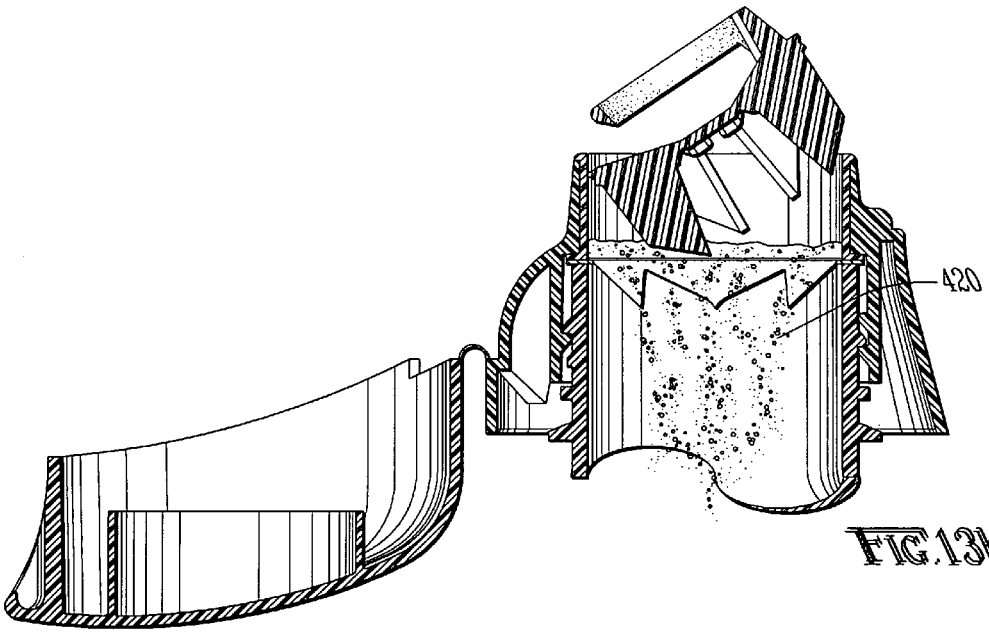

FIG. 13*b* is a side elevational view of the fourth form of the cap in a seal-piercing condition.

Figure 13C:
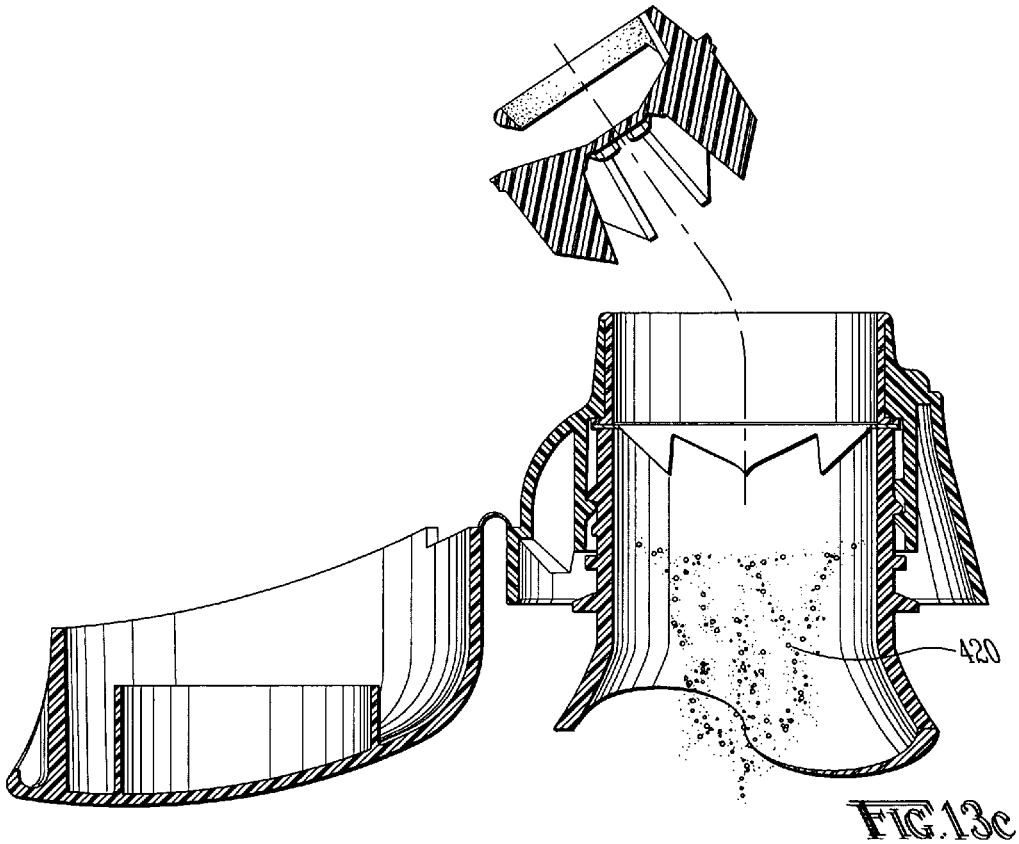

FIG. 13*c* is a side elevational view of the fourth form of the cap in a seal-piercing condition.

Figure 14:
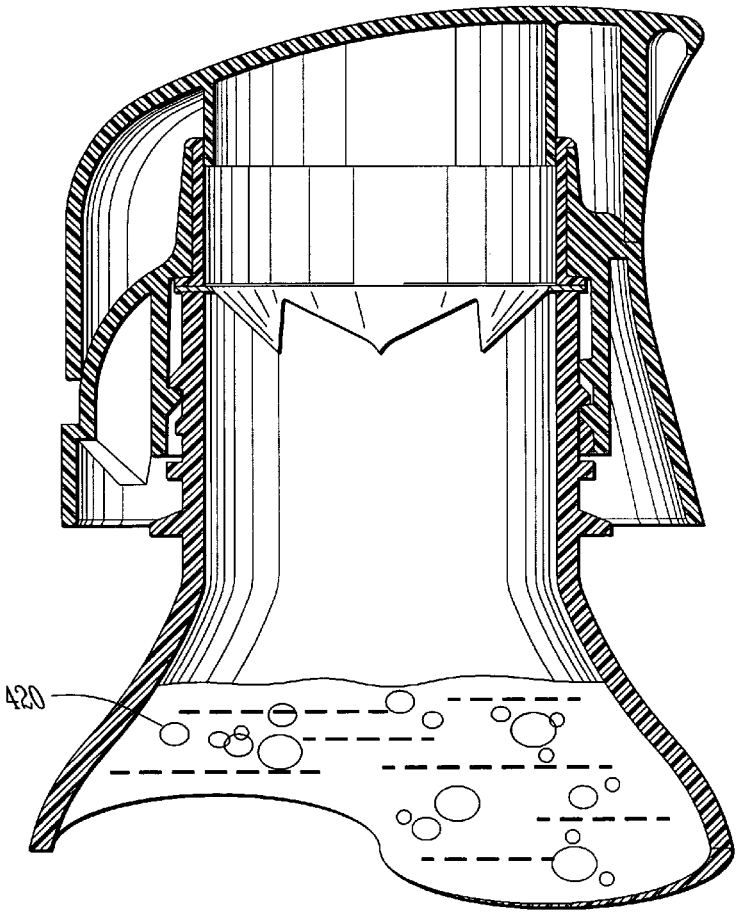

FIG. 14 is a side elevational view of the fourth form of the cap in a seal-piercing condition.

Figure 15:
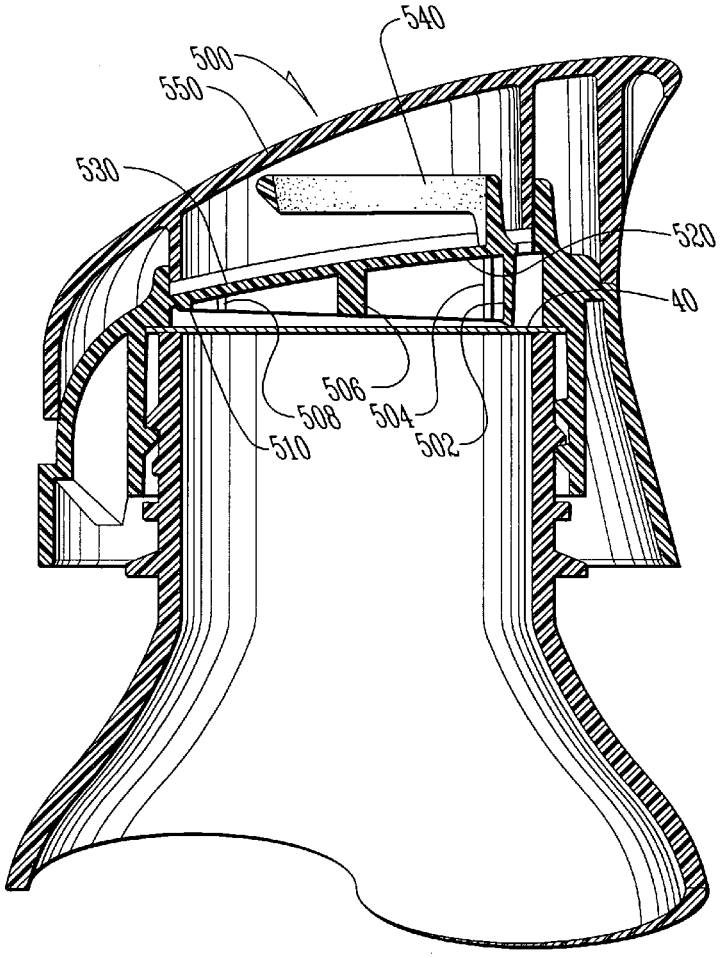

FIG. 15 is a side elevational view of a fifth form of a closure cap embodying the principles of the present invention in place on a container.

Figure 16:
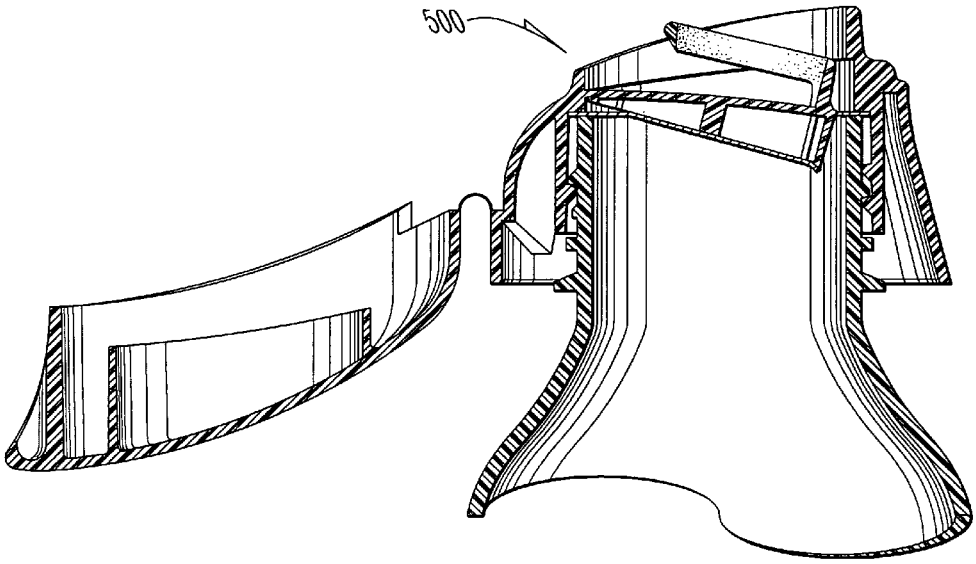

FIG. 16 is a side elevational view of the fifth form of the closure cap in an open and seal-piercing condition.

Figure 17:
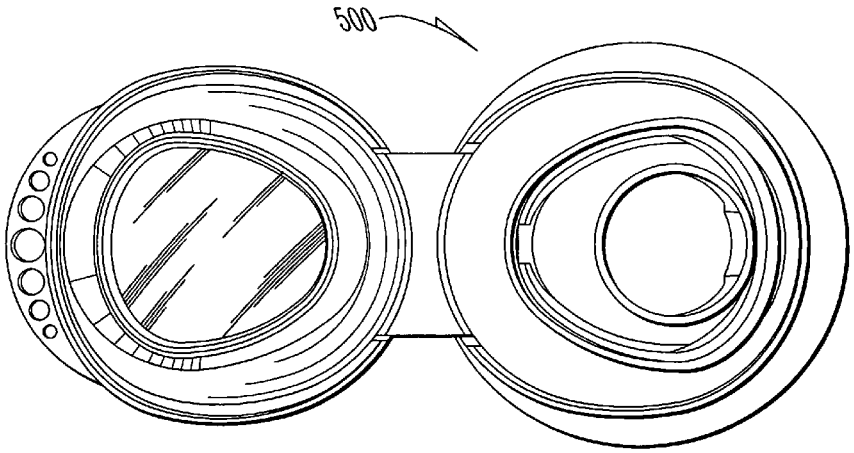

FIG. 17 is a top view of the closure cap shown in FIG. 16.

Figure 18:
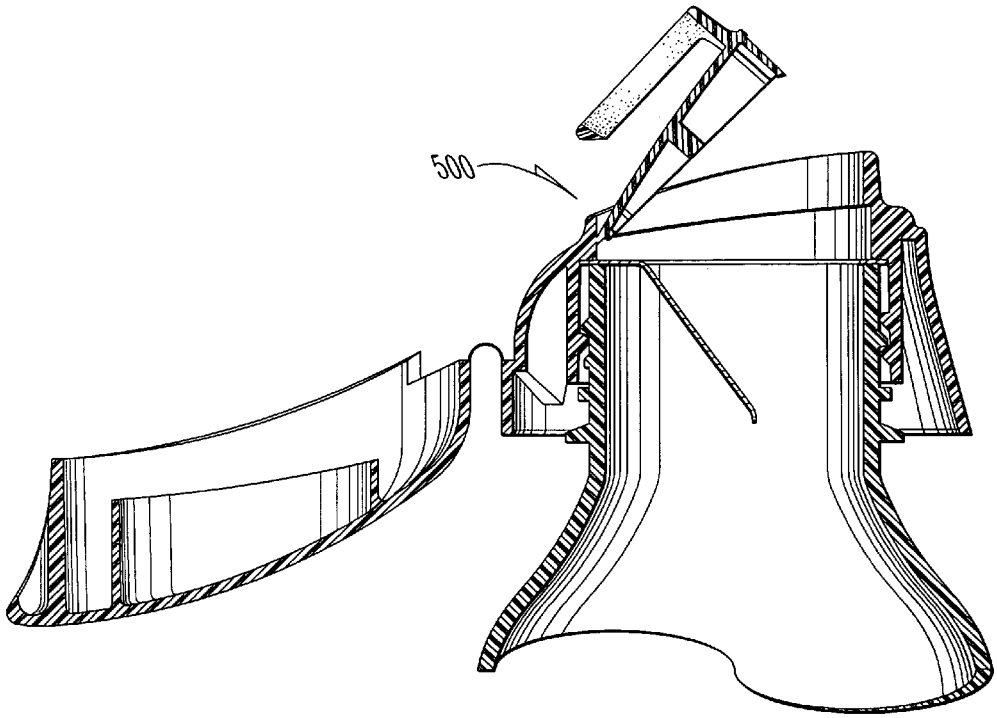

FIG. 18 is a side elevational view of the closure cap shown in FIG. 16 with the seal-piercing unit partially removed.

Figure 19:
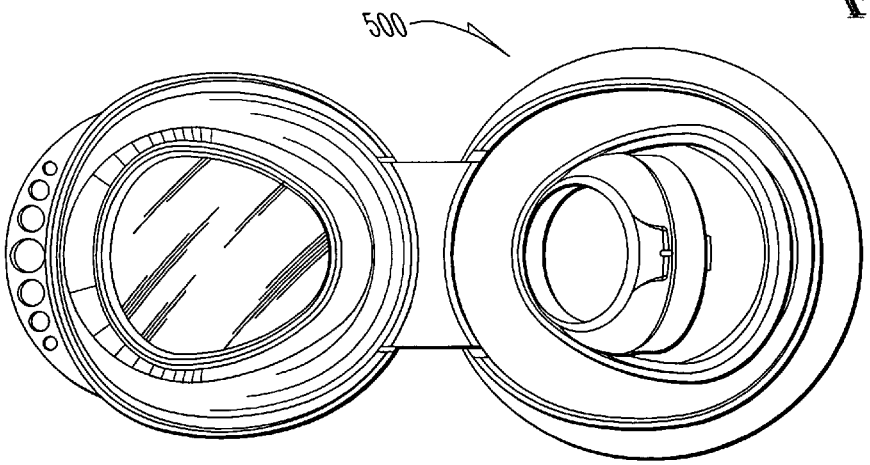

FIG. 19 is a top view of the cap as shown in FIG. 18.

Figure 20:
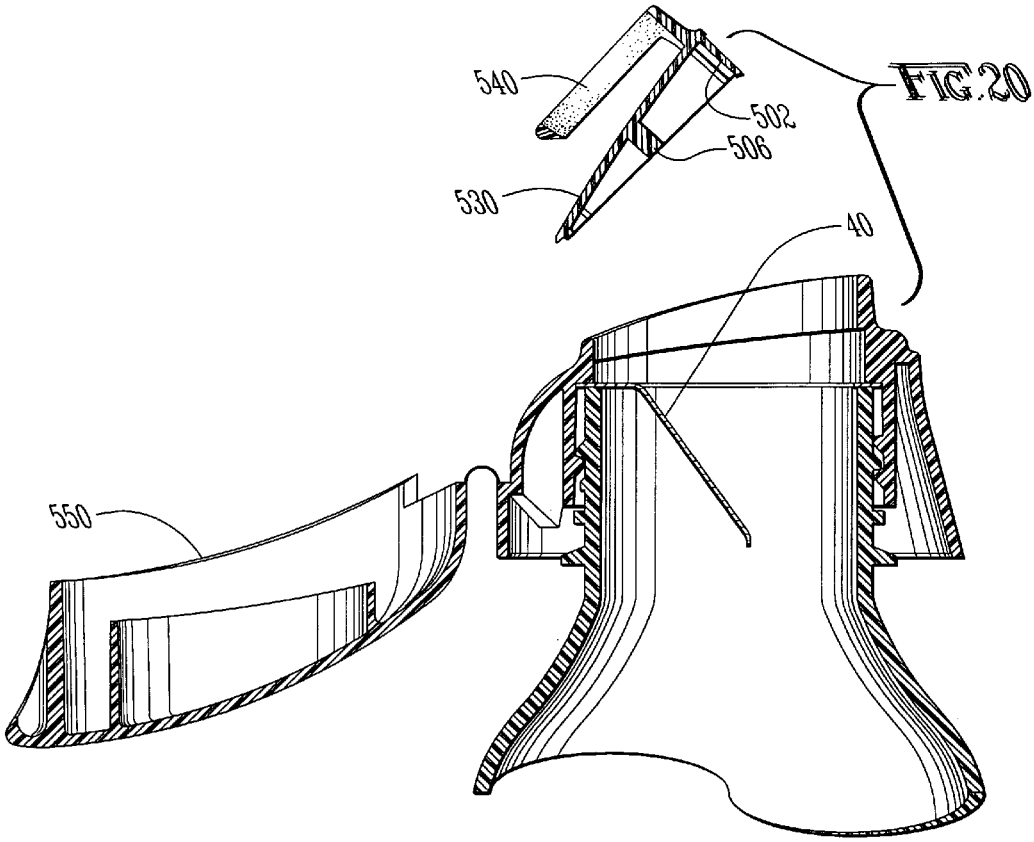

FIG. 20 is a side elevational view of the cap shown in FIG. 16 with the seal-piercing unit removed after piercing the seal.

DETAILED DESCRIPTION OF THE PREFERRED EMBODIMENT OF THE INVENTION

Other objects, features and advantages of the invention will become apparent from a consideration of the following detailed description and the accompanying drawings.

Figure 1:
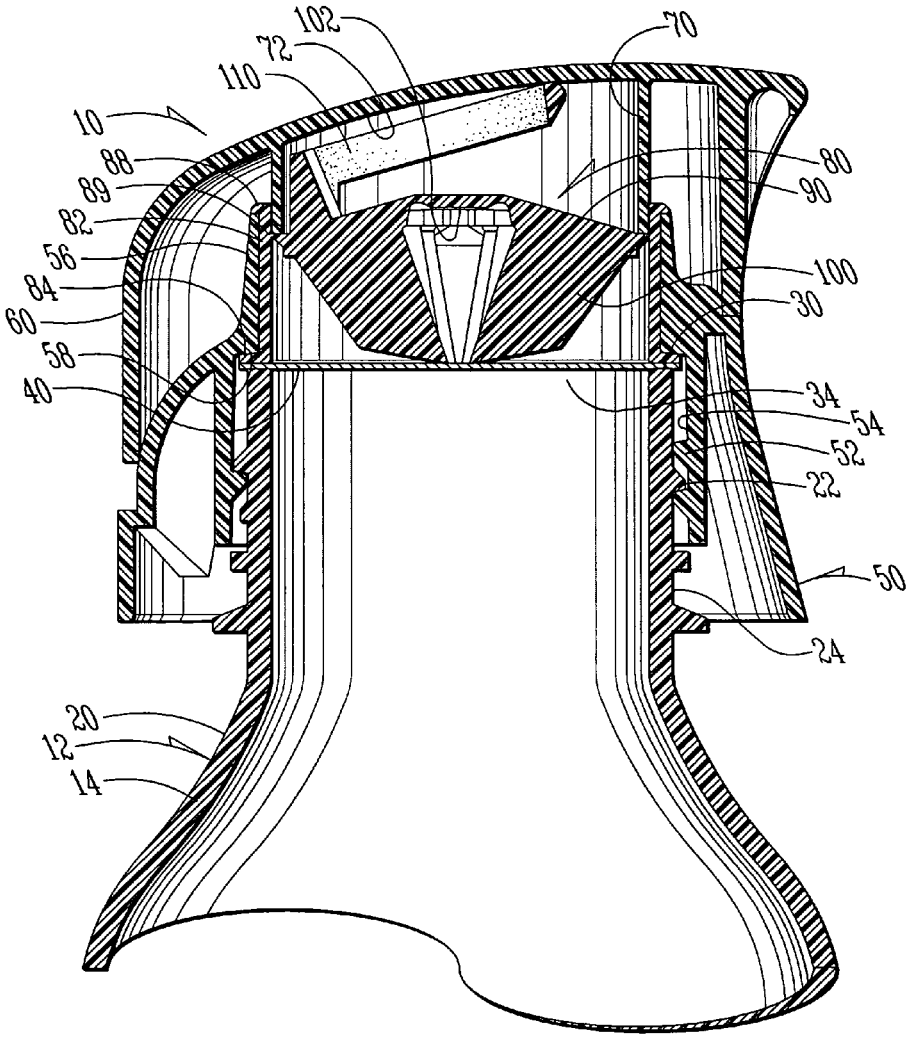
FIG. 1 is a side elevational view of a first form of a closure cap embodying the principles of the present invention in place on a container.
Figure 2:
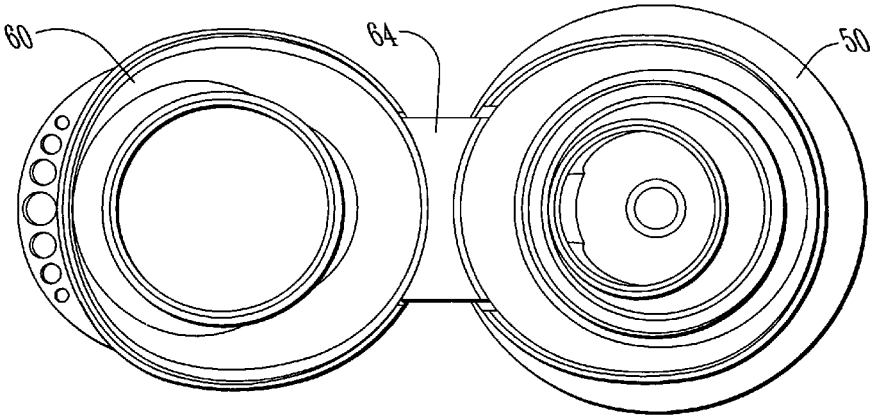
FIG. 2 is a top view of the FIG. 1 closure cap in an open condition.
Figure 3:
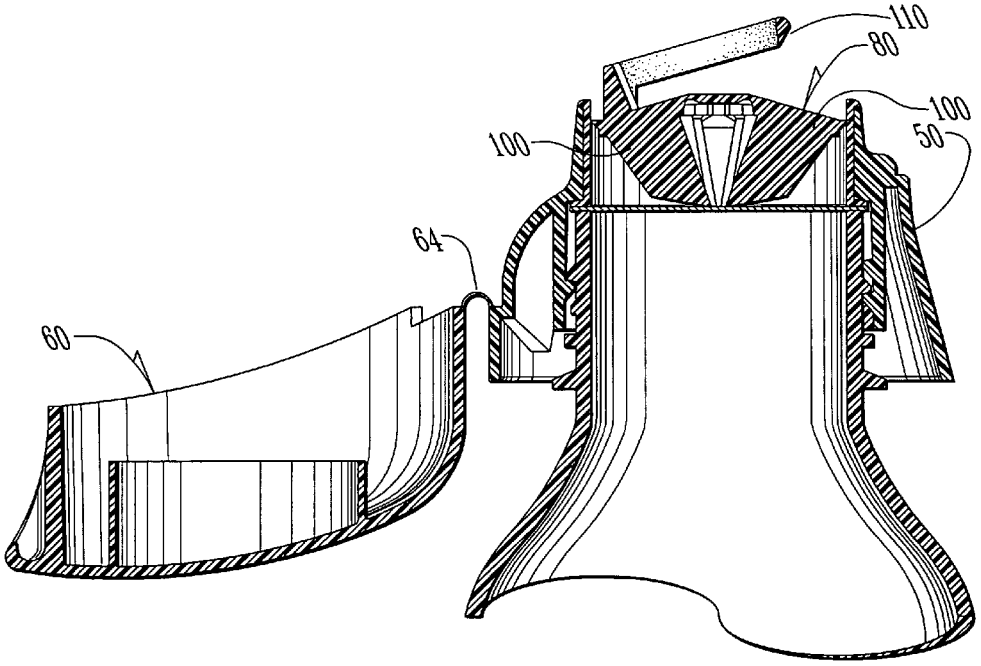
FIG. 3 is a side view of the FIG. 1 cap in an open condition.

Referring to FIGS. 1-3, it can be understood that the principles of the present invention are embodied in a closure cap 10 which is used to close a container 12 such as a bottle or the like, having a body 14 on which a neck finish 20 is surmounted. An external thread 22 is located on outside surface 24 of the neck finish and a top rim 30 is located on top of the neck finish when the container is in the upright orientation shown in FIG. 1 and defines a decanting port 34 through which fluid from the internal volume 36 of the container is discharged from the container. A seal 40 is located on the top rim to span port 34 to sealingly close that port. Seal 40 must be punctured or torn in order to decant the fluid from the container.

Closure cap 10 acts as an initial closure of the container and as a means for puncturing seal 40 when it is desired to use the contents of the container and then to re-close the container. Closure cap 10 includes a base 50 having thread 52 on inside surface 54 thereof to threadingly engage thread 22 of the container to mount cap 10 in place on the neck finish as indicated in FIG. 1. Base 50 further includes a tubular portion 56 having a shoulder 58 that is located and sized to abuttingly engage seal 40 and force that seal against the top rim of the container neck finish to further ensure sealing closure of the container when closure cap 10 is in place on the neck finish as can be understood from FIG. 1.

Cap 10 further includes a closure section 60 which is attached to the base by a hinge 64 to move between a closed condition shown in FIG. 1 and an open condition shown in FIG. 3. Closure section 60 includes a tubular portion 70 dependingly mounted on inner surface 72 of top 74 of the closure section. Tubular portion 70 is sized and located to be telescopingly accommodated in tubular portion 56 of the base when the closure is in the closed condition shown in FIG. 1.

A seal piercing unit 80 is mounted in cap 10 to be located immediately superadjacent to seal 40 when the cap is in an initial configuration as shown in FIG. 1. Seal piercing unit 80 includes a tubular portion 82 which is located immediately adjacent to tubular portion 70 and has a foot section 84 which abuttingly engages seal 40 between that seal and shoulder 58 of tubular portion 56 to be trapped therebetween and to further ensure the sealing function of seal 40. Attached to a top portion 88 of tubular portion 82 by a line of weakening 89 is a dome-shaped base 90. Dome-shaped base 90 is flexible and is adapted and configured to move from a first orientation with respect to seal 40, shown in FIG. 1 which is concave with respect to that seal to a second orientation with respect to seal 40 shown in FIG. 4 which is convex with respect to that seal. A plurality of seal-piercing knives, such as knife 100, are mounted on surface 102 of the dome-shaped base to be located immediately superadjacent to seal 40 when the dome-shaped base is in the first orientation as can be understood from FIG. 1. A finger-pull 110 is attached to the dome-shaped base to be spaced apart from that base as can be understood from FIG. 1.

Figure 4:
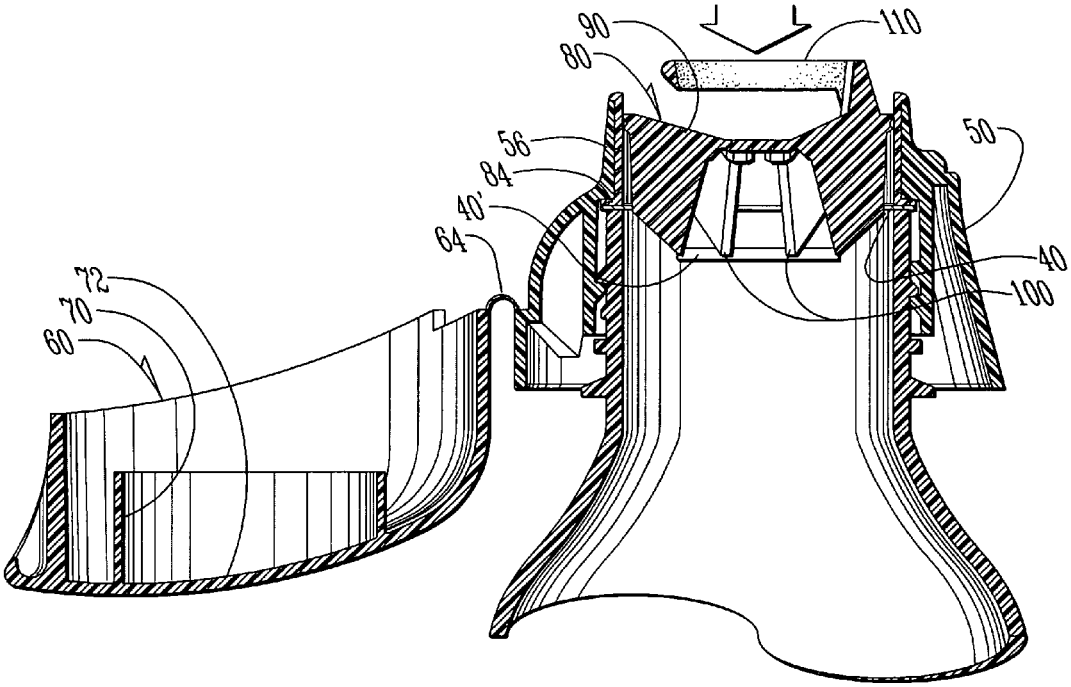
FIG. 4 is a side view of the FIG. 1 cap in the seal-piercing condition.
Figure 5:
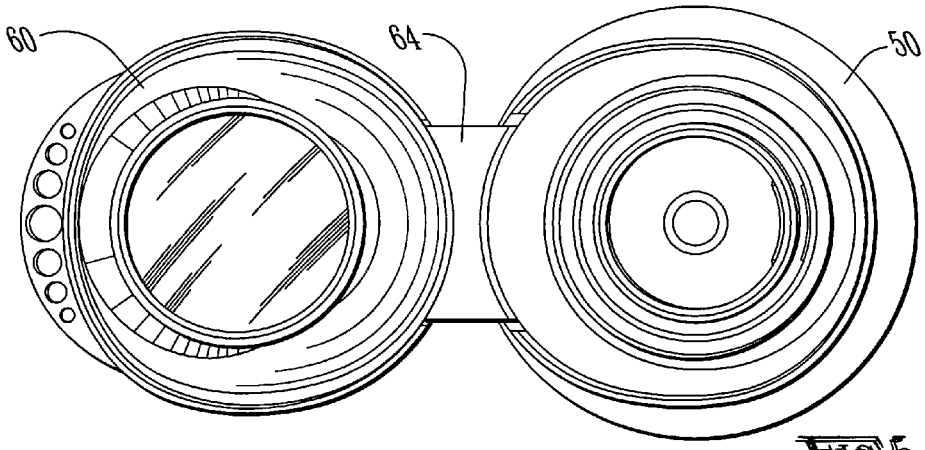
FIG. 5 is a top view of the FIG. 1 cap in the seal-piercing condition.
Figure 6:
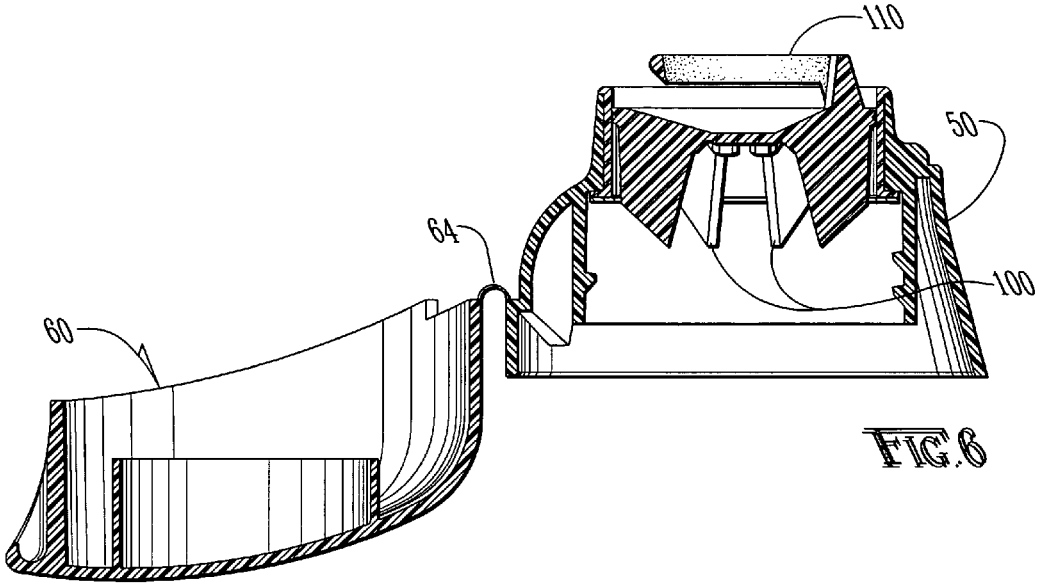
FIG. 6 is a side view of the FIG. 1 cap in the open condition after the container seal has been pierced.
Figure 7:
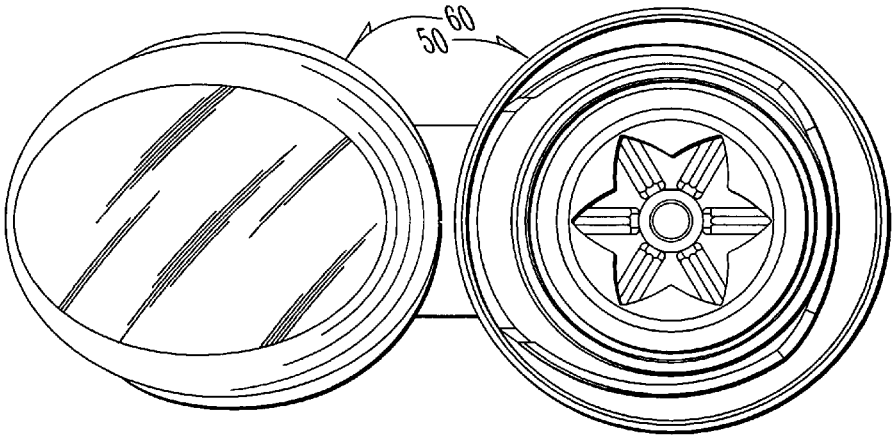
FIG. 7 is a top view of the FIG. 1 cap in the open condition after the container seal has been pierced.

As can be understood from FIGS. 1-6, after the closure section 60 is moved into the open condition to provide access to the dome-shaped base, the dome-shaped base is pushed toward the interior volume of the container by the user. The user can use his or her finger or thumb to execute this operation. When dome-shaped base 90 is forced from the first orientation thereof shown in FIG. 1 to the second orientation thereof shown in FIG. 4, the seal-piercing knives 100 are forced through seal 40 to tear slits or portions of that seal away as indicated in FIG. 4 by portion 40'. The seal-piercing knives are mounted on the dome-shaped portion to converge toward each other with respect to the seal as shown in FIG. 1 when the dome-shaped base is in the first position thereof and then to move when the dome-piercing portion is forced toward the seal and through the seal into the second position thereof as shown in FIG. 4 to diverge with respect to each other when the dome-shaped portion is in the second position thereof shown in FIG. 4. This tears the seal and opens a dispensing port 40P in the seal, as can also be seen in FIGS. 4 and 7.

Figure 8:
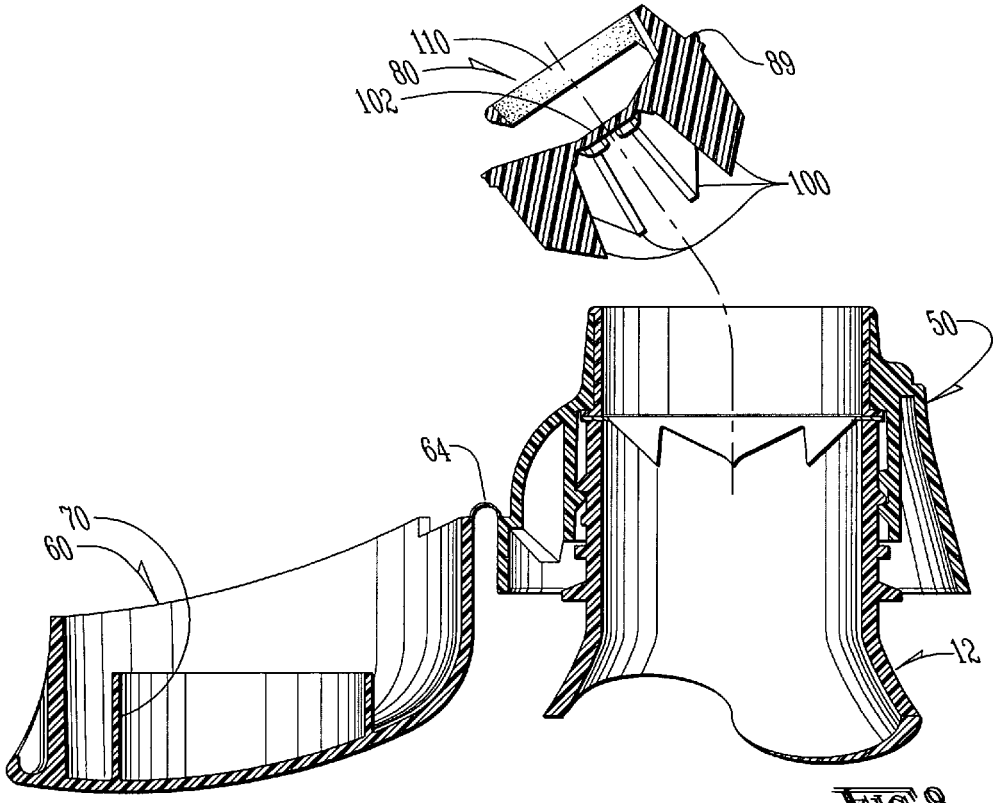
FIG. 8 is a side view of the FIG. 1 cap in the open condition after the container seal has been pierced and the seal-piercing unit of the cap has been removed from the remainder of the cap.
Figure 9:
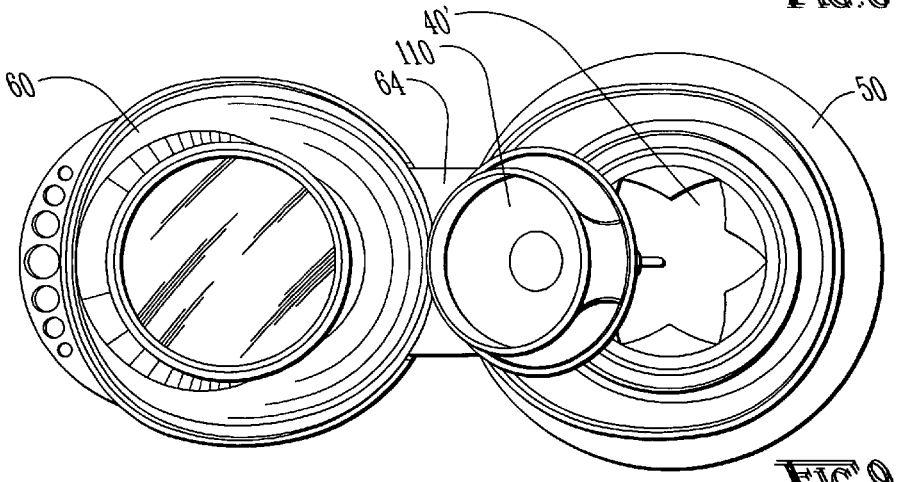
FIG. 9 is a top view of the cap as shown in FIG. 8.
Figure 10:
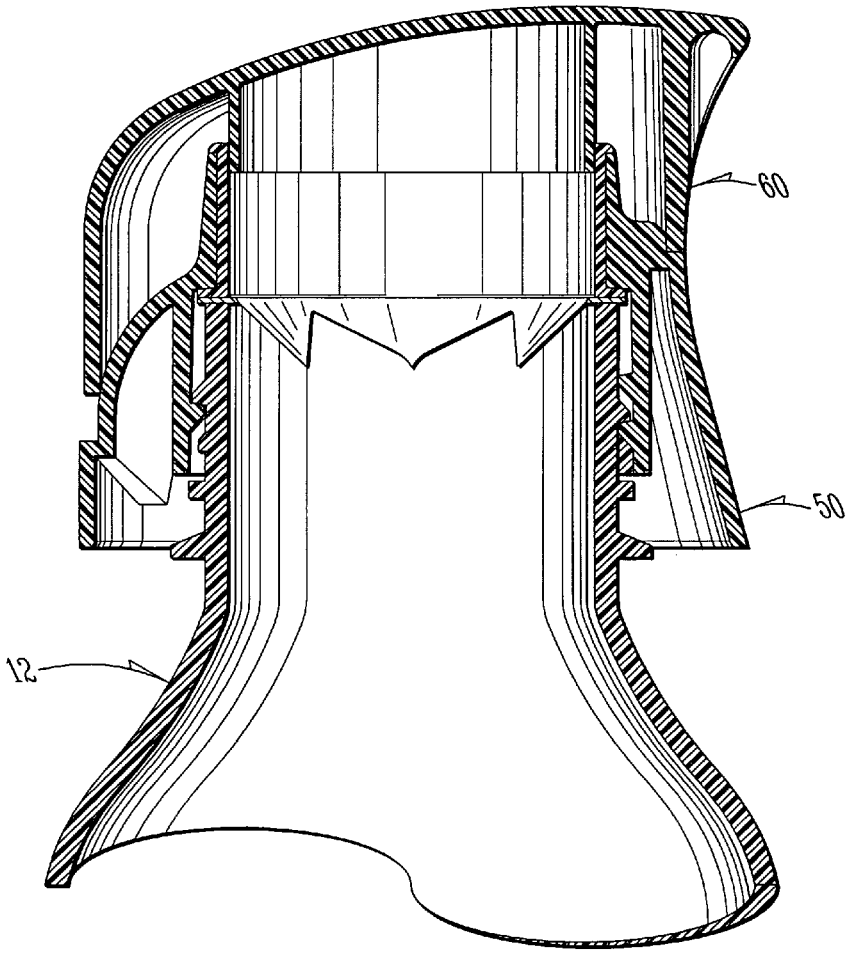
FIG. 10 is a side view of the FIG. 1 cap after the seal has been pierced and after the seal-piercing unit has been removed, with the cap in a container closing condition.

After the seal has been pierced, dome-shaped base 90 is removed from the closure cap so the cap can be operated without interference by the now superfluous seal-piercing unit. This is effected by grasping the finger-pull 110 and pulling the dome-shaped base away from the tubular portion 82. The line of weakening 89 will tear thereby releasing the dome-shaped base with the seal-piercing knives mounted thereon so it can be withdrawn from the vicinity of the remainder of the closure cap as can be understood from FIG. 8. The container can now be re-closed by moving closure section 60 from the FIG. 8 open condition into the FIG. 10 closed condition.

Figure 11:
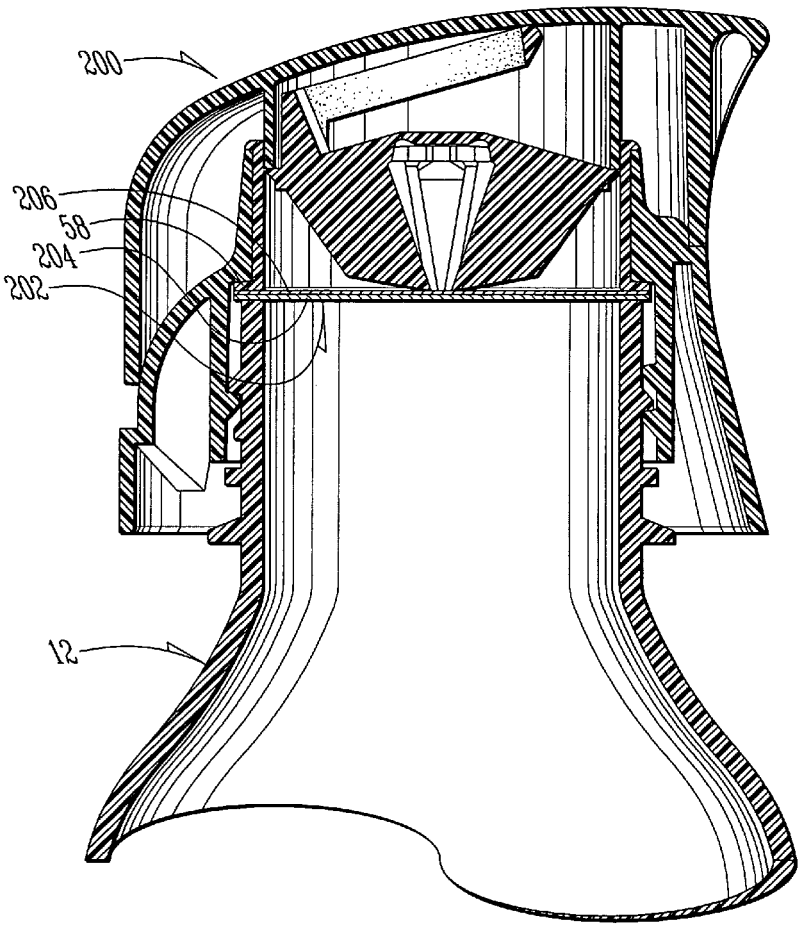
FIG. 11 is a side elevational view of a second form of a closure cap embodying the principles of the present invention in place on a container.

The principles of the present invention can also be embodied in further forms of the closure cap as disclosed in FIGS. 11-15. Referring thereto, it can be understood that closure cap 200 shown in FIG. 11 is used in conjunction with a double seal unit 202 which has a first seal 204 fixed to rim 30 of the container and second seal 206 fixed to shoulder 58 of cap 200 to be congruent therewith. This creates a hermetic seal between the container and the cap. Cap 200 is otherwise similar to above-described cap 10 and operates and functions in an identical manner.

Figure 12:
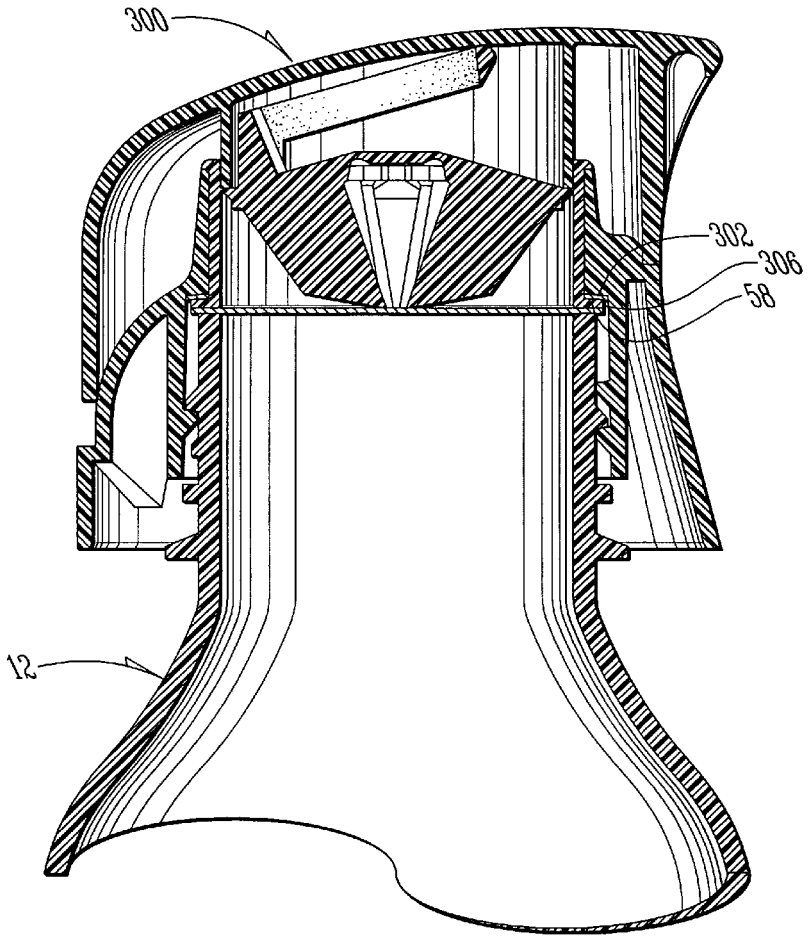
FIG. 12 is a side elevational view of a third form of a closure cap embodying the principles of the present invention in place on a container.

Closure cap 300 shown in FIG. 12 includes a double-sided seal ring 302 which encases shoulder 58 interadjacent to the perimeter 306 thereof. The double seal ring defines a hem located interadjacent to the perimeter of the seal. This also creates a hermetic seal between the closure cap and the container. Cap 300 is otherwise similar to above-described cap 10 and operates and functions in an identical manner.

Closure cap 400 shown in FIGS. 13 and 14 includes an inner volume section 402 between a seal 406 and surface 408 of dome-shaped base 409. Cap 400 is operated in a manner similar to the above-described caps to force dome-shaped base 409 from a first orientation to a second orientation to force knives 410 through seal 406 to define a port through that seal. A powder 420 is stored in inner volume section 402 and moves, under the influence of gravity, through the port defined by the knives and can be mixed with the fluid stored in the container as indicated in FIG. 14. Closure cap 400 otherwise operates and functions in the manner described above with regard to the other closure caps.

Closure cap 500 shown in FIGS. 15-20 includes a plurality of seal-piercing elements 502-510 on an inner surface 520 of a flexible dome-shaped base 530 to be located immediately superadjacent to seal 40 on the container. Dome-shaped base 530 is forced toward the container as above described to move the seal-piercing elements toward and through the seal to thereby pierce that seal and define a fluid discharge port therethrough as above described. As described above, once the seal has been pierced as shown in FIGS. 16 and 17, the dome-shaped base with the seal-piercing elements thereon becomes superfluous and is removed from the cap and discarded using pull ring 540 to remove the dome-shaped base from cap 500 as can be understood from FIGS. 18-20. The closure section 550 of cap 500 can then be moved from its open condition shown in FIG. 20 to a container closing condition similar to the closed condition for cap 10 shown in FIG. 10.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A closure unit for opening a seal covering a discharge port of a container comprising:

a base configured to secure to the container;

a tubular portion extending upwardly from the base;

a flexible base section mounted to the tubular portion by a line of weakness and mounted adjacent to a seal covering a discharge port of a container, the flexible base section being movable between a first position with respect to the seal and a second position with respect to the seal with the second position being closer to the seal than the first position;

at least one seal piercing element mounted on the flexible base section to move therewith;

the flexible base section and the at least one seal piercing element being oriented and positioned relative to the seal to move the at least one seal piercing element through the seal and to cut at least one slit in the seal when the flexible base section moves from the first position thereof to the second position thereof;

a pull ring attached to the flexible base section which permits the flexible base section to be removed from the tubular portion when the line of weakness is broken.

2. The closure unit defined in claim 1 further including a cap element mounted on the base to move between a discharge port covering condition and a discharge port uncovering position.

3. The closure unit defined in claim 1 wherein the flexible base section is dome-shaped to be concave with respect to the seal in the first position and to be convex with respect to the seal in the second position.

4. The closure unit defined in claim 1 further including a tubular element located on the cap element, and wherein the tubular portion on the base is further configured to surround the tubular element on the cap element when the cap element is in the discharge port covering condition.

5. The closure unit defined in claim 1 further including a second seal mounted on the flexible base section to be located adjacent to the seal covering the discharge port of the container.

6. The closure unit defined in claim 1 further including a thread on the base which threadably mates with a thread on the discharge port of the container when the base is in place on the container.

7. The closure unit defined in claim 1 further including an interior volume defined between the seal and the flexible base section.

8. A closure unit for covering a discharge port of a container comprising:

a seal secured to a rim of a container to cover and seal a decanting port of a container;

a seal-piercing unit positioned on the container adjacent to the seal and including:

a tubular portion having a foot section which engages the seal adjacent to the rim of the container so the seal is located between the foot section and the rim of the container, a line of weakening on the tubular portion, at least one seal-piercing element, a flexible base unit mounted adjacent to the seal covering the decanting port of the container and connected by a line of weakness to the tubular portion, the flexible base unit being movable between a first orientation with respect to the seal and a second orientation with respect to the seal, wherein the second orientation being closer to the seal than the first orientation, the at least one seal-piercing element being mounted on the flexible base unit for movement therewith and being located to pierce the seal and move through the seal to cut at least one slit in the seal when the flexible base unit is moved from the first position thereof to the second position thereof, and a pull ring attached to the flexible base unit, flexible base unit being detached from the tubular portion when the line of weakening is broken; and a closure section which includes a hinge connecting the closure section to the seal-piercing unit.

9. The closure unit defined in claim 8 wherein the closure section includes a tubular section which is located and positioned on the closure section to accommodate the flexible base unit adjacent to the pull ring.

10. The closure unit defined in claim 8, wherein the at least one seal-piercing element includes a plurality of seal-piercing elements.

11. The closure unit defined in claim 10 wherein the seal-piercing elements are mounted on the flexible base unit to be oriented to converge toward each other toward the seal when the dome-shaped portion is in the first position thereof and to diverge away from each other with respect to the seal when the flexible base unit is in the second position thereof.

12. The closure unit of claim 8 wherein the flexible base unit is dome shaped.

* * * * *